United States Patent [19]

Gobel

[11] Patent Number: 4,860,462

[45] Date of Patent: Aug. 29, 1989

[54] FLIGHT ARRANGEMENT FOR ROTARY DRUM DRYERS

[75] Inventor: Richard J. Gobel, Scappoose, Oreg.

[73] Assignee: Beloit Corporation, Beloit, Wis.

[21] Appl. No.: 177,193

[22] Filed: Apr. 4, 1988

[51] Int. Cl.[4] ..... F26B 11/02

[52] U.S. Cl. ..... 34/108; 34/136

[58] Field of Search ..... 34/108, 130, 131, 132; 432/104, 105, 118

[56] References Cited

U.S. PATENT DOCUMENTS

| | | | |
|---|---|---|---|
| 3,717,937 | 2/1973 | Thompson | 34/108 |
| 3,720,004 | 3/1973 | Okawara | 34/130 |
| 3,798,789 | 3/1974 | Thompson | 34/108 |
| 3,861,055 | 1/1975 | Thompson | 34/10 |
| 4,549,699 | 10/1985 | Thompson | 34/108 |

*Primary Examiner*—Henry A. Bennet

*Attorney, Agent, or Firm*—Dirk J. Veneman; Raymond W. Campbell; Gerald A. Mathews

[57] ABSTRACT

A rotatable hollow drum for a dehydrator has an inlet at one end and an outlet at the other end. A longitudinal shaft extends axially from one end of the drum to the other. A plurality of circumferentially-spaced, longitudinally extending flights are mounted to the inner side of the hollow drum. A plurality of circumferentially-spaced flights is also mounted to the shaft with each of these flights also extending along the shaft. The flights on both the drum and shaft uniquely comprise a plurality of tines which may have their ends bent, at progressively increasing angles, for intercepting, turning, separating and enhancing the conveyance of pieces of material being dried in the dehydrator as the pieces travel from one end to the other as the dehydrator rotates. This action promotes constant movement of the material in the dehydrator to provide uniform drying of individual pieces while reducing the likelihood of blockage caused by the accumulation of pieces.

10 Claims, 2 Drawing Sheets

FLIGHT ARRANGEMENT FOR ROTARY DRUM DRYERS

BACKGROUND OF THE INVENTION

This invention relates to a drum for a rotary drum-type dehydrator. More specifically, this invention relates to a unique type of flighting in a drum-type dehydrator wherein pieces of material to be dried, such as wood chips, hog fuel and bagasse can be momentarily separated, turned and more evenly exposed to hot drying gases passed through the drum to more evenly dry all of the pieces while maintaining a steady rate of conveyance of the materials through the dehydrator.

Dryers of the type of this invention are commonly known in the pulp and paper industry as rotary wafer dryers. These dryers are used to dry large pieces of material such as wood chips, hog fuel or bagasse, which are dried before further processing into small pieces used, for example, to produce waferboard. Typically, wood chips dried by these dryers might range in size from about 0.02 to about 0.1 inch thick by 0.25 to about 3.0 inches wide by 2.75 to about 18 inches long wafers. The drum of these dryers is large, such as about 12 feet in diameter and about 20–40 feet in length. They are typically disposed to rotate about their longitudinal axis, which coextends with their center shaft in a horizontal plane or in a plane at a small angle to the horizontal.

Prior dehydrators of this type utilized a drum having a plurality of plate-like flights mounted to both the inner surface of the drum and the center shaft extending coaxially with the axis of drum rotation. These flights, which may be about 8–12 inches long, in the axially-extending direction, are arrayed in longitudinally-extending parallel rows. They extend radially outwardly from the shaft and have their ends bent. In operation, these flights carry the material to be dried as hot gases are introduced into one end of the drum and are removed from its other end. In the context of this invention, the term dehydrator is used to designate all parts of the apparatus, including framework, the source of supply of the hot gases, bearings and motor for rotatably supporting and driving the apparatus, and the dryer drum itself.

The purpose of flights in this type of dehydrator drum is to support most of the material passing through the drum in a plurality of relatively small groups of pieces which are spaced above the lowermost portion of the inner surface of the substantially horizontally disposed drum. In this way, the pieces of material intercept more of the hot drying gases passes through the dehydrator drum.

A problem with the operation of such prior dryers is that the plate-like flights tend to keep at least some of the pieces of material in approximately the same position on the flight, and location within the drum, for a longer period than is required to dry the pieces to the desired dryness. This causes plugging in the dryer as new pieces enter which, if not alleviated by removing dried pieces, can cause fires as well as produce large void areas downstream of the plugged section of the drum. Since no pieces of material are in the void areas to absorb the heat of the high temperature gases passing through the dryer, the gases exiting the dryer have a higher temperature than desired, thus lowering the thermal efficiency of the drying process. Further, the accumulated pieces tend to shield some pieces from the hot gases and prevent them from being dried to the desired dryness.

Some prior dryer designs stagger the successive flights of the plates along the length of the dryer drum, or shaft, to promote continuous movement of the pieces of material in the longitudinal direction through the dryer. However, this does not produce a steady, continuous flow of material through the dryer because the plate-like flights still function to essentially carry the material without turning it or providing a tumbling action.

Another problem with the plate-like flights is they become quite hot during operation of the dehydrator. When pieces of wood and bagasse reside on their relatively large surface for a period of time, they can become scorched, which diminishes the quality and value of the dried product.

The problems associated with the plugging and uneven drying of the pieces of material in prior rotary drum dryers are obviated by this invention. In this apparatus, the flights comprise a plurality of tines which extend radially inwardly from the wall of the drum and radially outwardly from the core shaft. The tines have ends which are either individually arrayed to describe a helical path in the longitudinal direction of the drum, or individual short sections of tines are so arrayed. The tines are equally spaced circumferentially about the surfaces of the drum and shaft. The ends of either individual tines, or small groups of contiguous tines in the same longitudinal row, are bent to promote movement of the pieces in different directions as they fall from the tines under the influence of gravity and rotation of the drum. Not all of the ends of the tines need be bent, and the ends of the tines which are bent need not be bent in the same direction, or angle. In fact, bending the tines in different directions, but generally forwardly in the direction of drum rotation, enhances the tumbling movement of the pieces of material both between tines in the same longitudinally-extending row as well as between tines in the circumferential direction.

The tines promote flow of the material circumferentially as well as in the downstream, or longitudinal, direction along the axis of the shaft of the drum. This facilitates its passage through the drum without causing a blockage. In the process, the continuous movement of the material around and between the tines promotes uniform drying.

Accordingly, it is an object of this invention to provide a drum for a dehydrator wherein the flights in the drum are comprised of tines.

Another object of this invention is to provide apparatus for a drum-type dehydrator which promotes uniform and efficient transfer of heat from hot gases to pieces of material passing through the drum.

Another object of the invention is to provide a rotary drum for a dehydrator which incorporates a flight arrangement which promotes uniform drying among the pieces of material being passed through the dehydrator.

Still another object of the invention is to provide a tine flight arrangement in a dehydrator drum which alleviates jamming, cording and wedging of wafers passing through the drum.

An advantage of the invention is the maximization of the exposure of material to flowing gases in a rotary drum dehydrator.

These and other objects, features and advantages of the invention will become more readily apparent to those skilled in the art upon reading the description of the preferred embodiment in conjunction with the attached drawings.

DESCRIPTION OF THE PREFERRED EMBODIMENT

Figure 1:
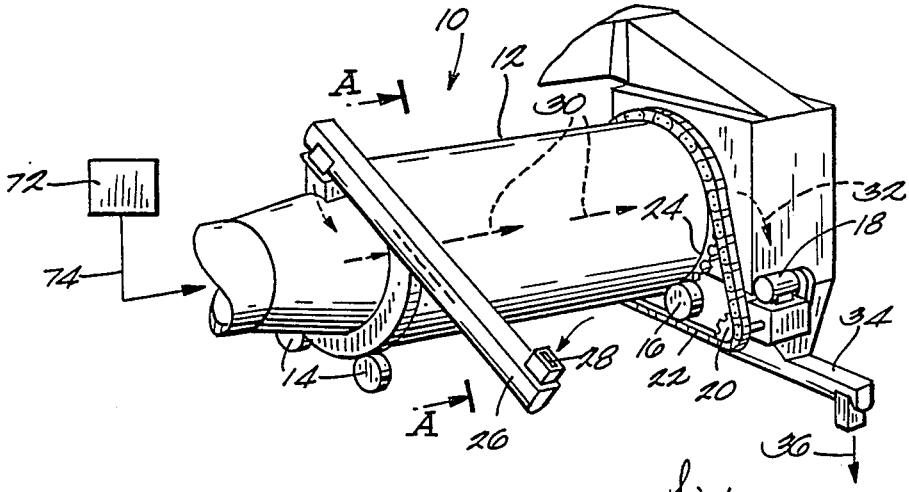
FIG. 1 is a perspective view of a dehydrator and the drying drum.

As shown in FIG. 1, a dehydrator 10 has a drum 12 mounted on a pair of trunions 14,16 at either end to permit it to be rotated, with its longitudinal axis substantially horizontal, by a motor 18 turning a pinion 20 which is linked to a chain 22 which is looped over a sprocket 24 on one end of the dryer drum. An infeed conveyor 26 is located at one end of the apparatus for feeding pieces of material to be dried into the dehydrator. Material, such as wafers, enters an opening 28 at the lower end and is discharged into the open-ended dryer drum from the other end of the conveyor.

The flow of the material is in the direction along the longitudinal axis of the dehydrator dryer drum as indicated by arrows 30. The material exits from the open back end of the dryer drum as indicated by arrow 32 where it is collected and discharged by an enclosed outfeed device 34 in the direction of arrow 36.

Figure 2:
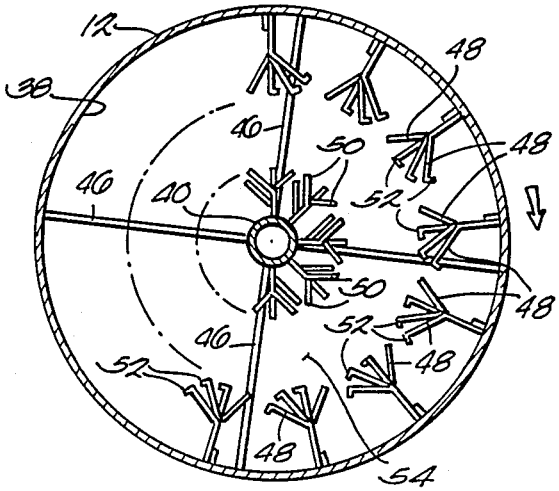
FIG. 2 is a cross-section view of the drum through section A—A in FIG. 1.

As shown in FIG. 2, the dryer drum 23 comprises a hollow shell having an inner surface 38. A center shaft 40 is supported with its longitudinal axis coaxial with the axis 42 of drum revolution, the direction of which is indicated by arrow 44. The center shaft 40 is positioned and supported in the center of the dryer drum by a plurality of spacer bars 46, each of which has one end mounted to the inner surface 38 of the roll drum 12 and the outer surface of the shaft 40.

A plurality of tines 48 are mounted to the inner surface of the drum wall and extend longitudinally therealong in a plurality of substantially parallel rows. Typically, these rows are circumferentially spaced from one another at distances ranging from about 10 inches to about 18 inches. In the longitudinal direction, the tine spacing might range from about 1 inch to about 12 inches, depending on the size of the pieces of material being processed.

A plurality of rows of tines 50 are also mounted to the shaft 40 and extend longitudinally therealong. These rows of tines 50 are also spaced circumferentially from one another, but there are fewer such rows than on the shell and their circumferential spacing is less than that of the tines on the drum. The longitudinal spacing between tines in the same row along the shaft also ranges from about 1 inch to about 12 inches.

Figure 3:
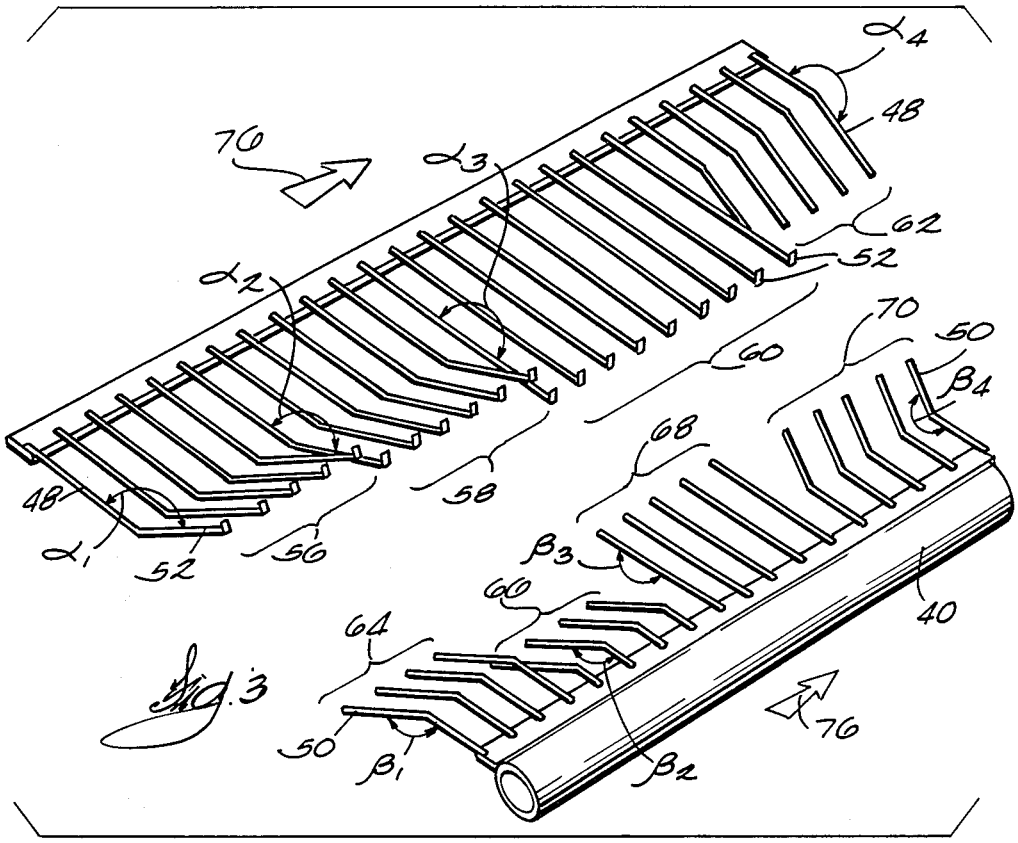
FIG. 3 is a perspective view showing a typical row of tines for mounting on the drum and an opposing row of tines for mounting on the shaft.
Figure 4:
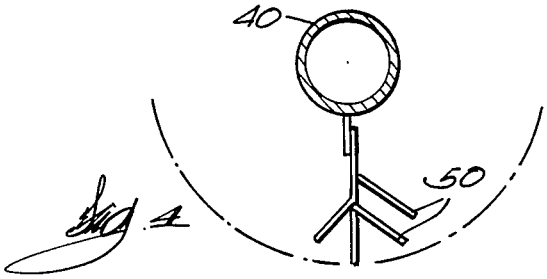
FIG. 4 is an end view of the centershaft tine flights, such as shown in FIG. 3, and showing the spiral configuration of these flights.

As shown in both FIGS. 2 and 3, the distal ends of the tines are bent and some tines have a lip 52 on their tip to facilitate their retention of pieces of material, such as wood wafers, during their passage through the dryer drum. As shown in FIG. 2, the ends of the tines on the shaft are spaced from the ends of the tines on the roll shell to provide an inner space 54 for the material to fall unencumbered from the drum tines to the shaft tines.

With reference to FIG. 3, adjacent drum tines 48 can be arranged in groups of, for example, 4–10 tines. All of the tines in one group 56 having their distal ends bent in the same angle $\alpha_1$ while the tines in successive groups 58,60,62 have their ends bent in successively larger angles $\alpha_2$, $\alpha_3$ and $\alpha_4$. The tips of the ends of successive groups of tines describe a helical path in the longitudinal direction along the length of the drum.

Similarly, the tines 50 mounted to the shaft are shown grouped with several tines in each group 64,66,68,70, and the distal ends of the tines in each group being bent at the same angle. The tines in each successive group have ends which are bent at successively larger angles $\beta_1$, $\beta_2$, $\beta_3$, $\beta_4$. Other configurations of progressive spirals also are used primarily on the centershaft.

In operation, a source of hot gases, such as the products of combustion from a furnace 72, are directed into the entrance end of the dehydrator dryer drum 12 as indicated by directional arrow 74. Wood wafers are introduced into the open inlet end of drum 12 via infeed conveyor 26. There, they encounter the hot drying gases introduced through the same inlet end of the drum.

With reference to FIG. 3, tine group 56 encounters the material first and lifts it upwardly as the drum rotates. Some of the pieces of material fall between the tines in group 56 and onto tines in the next flight rotating upwardly in the circumferential direction along the inner surface of the drum. Some of the pieces of material turn about the relatively narrow width of the tines and are thus urged axially downstream in the drum in the direction of arrow 76 to fall onto the next group of tines 58. This process of urging individual pieces of material as well as small collections of material either downwardly through the tines or downstream onto a succeeding group of tines in the downstream direction continues as the drum rotates.

At some point near the upper two quadrants, as shown in FIG. 2, of the generally horizontally-disposed dryer drum, pieces of material are urged to fall downwardly from the drum tines under the influence of gravity. At this point, in order to separate and further mix the pieces of material, the lips on the ends of some of the tines operate to restrain and delay the fall of some of the material downwardly into the space 54 between the drum tines and the shaft tines. As the drum tines 48 rotate downwardly in the lower two quadrants, as shown in FIG. 2, the lips 52 on the ends of the tines function to intercept part of the pieces of material and prevent them from falling all the way down to the inner surface of the drum. This allows the hot gases to swirl around and contact the surface of more individual pieces of material to more thoroughly dry the pieces as well as provide a more uniformly dried product leaving the dehydrator. Since the distal ends of the tines in group 62 are bent backward, relative to the direction of drum rotation, there is no need for lips on these tines.

The tines 50 mounted on the shaft operate in much the same manner as the tines on the drum. However, since the shaft tines are relatively close to the center of the drum, there is no special need for any lips corresponding to lips 52 on the drum tines to intercept and retard movement of pieces of material inwardly or outwardly relative to the ends of these tines. The tines on the shaft also have their distal ends bent, in the preferred embodiment, with groups of tines 64,66,68 and 70 extending in the downstream direction having progressively greater angles of bending to allow the tines to operate to separate the pieces of material as well as to turn and convey them in a tumbling action downstream.

The individual tines on the drum and shaft can be round, square or rectangular in cross sectional shape. The significance of their shape is that they are relatively narrow compared to the size of the pieces of material being dried in the dehydrator so they can operate to turn or separate pieces of material to move over their surface and either fall downwardly between adjacent tines or travel downstream onto the next tine, or group of tines, or both. In this manner, the flights, which might be characterized as comprising a group of tines, such as groups 56 and 58, operate to maintain the individual pieces of the mass of material being processed through the dehydrator in a constant state of separation and relative spacing with few, or no, voids as opposed to either a single mass of material or several relatively large masses of material separated by voids.

In other words, the tines promote movement of pieces of material (1) circumferentially about the inner surface of the drum between successive rows of flights of tines, (2) axially from one group of tines to another group of tines in the same row, and (3) diametrically from the tines in the upper two quadrants of the horizontally-disposed drum to the tines in the lower two quadrants. This promotes showering and enhances exposure of all the pieces to the hot drying gases while discouraging jamming, cording and wedging of wafers and the attendant voids within the dehydrator drums.

At the open exit end of the drum, the dried pieces of material are dumped into a bin over an outfeed device 34 for conveyance out of the apparatus in the direction of arow 36.

Thus, an improved flight arrangement utilizing tines for a drum in a dehydrator has been shown and described which achieves the objectives and incorporates the advantages set forth. Various modifications and changes in the flight and tine arrangement are possible without departing from the spirit and scope of the appended claims which define the invention. Thus, the distal ends of successive individual tines could be bent at slightly different angles, increasing in the downstream direction, so that the tips of the tines would describe a more smooth helical path than is described by the tip of successive groups of tines. Also, it is contemplated that flights made up of tines could be combined in drums having other flights which are made of the prior plate-like construction. For example, flights made of tines could be mounted alternately in the circumferential direction with flights made of the plate-like construction. This could be done for the flights on both the drum and the shaft. Finally, while the dehydrator drum has been described as rotating about a horizontal axis, this axis can be set to rotate at a slight angle to the horizontal.

What is claimed is:

1. In a drum for a rotatably driven dehydrator through which pieces of material are passed and dried by hot gases, the drum being hollow, open at either end and including a longitudinally extending shaft, the improvement comprising:

a plurality of flights are mounted along the inner surface of the hollow drum, each flight extending longitudinally from one end of the drum to the other end, and spaced circumferentially about the inner surface of the drum, at least some of the flights comprising a plurality of tines extending inwardly from the drum;

a plurality of flights are mounted to the shaft, each flight extending substantially longitudinally therealong, and spaced circumferentially about the shaft, at least some of the flights comprising a plurality of tines extending outwardly from the shaft;

whereby the tines intercept the material introduced into the drum and separate, turn, move and convey pieces of the material as the drum rotates.

2. The drum apparatus as set forth in claim 1, wherein:

the tips of the tines on the drum or the shaft, or both, describe a helical path in the longitudinal direction.

3. The drum apparatus as set forth in claim 1, wherein:

each of the flights on the inner surface of the drum comprise a plurality of tines.

4. The drum apparatus as set forth in claim 1, wherein:

the ends of at least some of the tines on the drum or the shaft, or both, are bent, whereby pieces of material intercepted by the tines are further turned, separated and exposed to the drying gases as the drum rotates.

5. The drum apparatus as set forth in claim 4, wherein:

the tines in at least some flights are grouped into groups with the ends of the tines in each group bent at the same angle in the same direction.

6. The drum apparatus as set forth in claim 4, wherein:

the ends of at least some of the bent tines are bent at different angles in the direction of drum rotation.

7. In a drum for a rotatably driven dehydrator through which pieces of material are passed and dried by hot gases, the drum being hollow, open at either end and including a longitudinally extending shaft, the improvement comprising:

a plurality of flights are mounted along the inner surface of the hollow drum, each flight extending from one end of the drum to the other end, the flights being spaced circumferentially about the inner surface of the drum, and each flight comprising a plurality of inwardly extending tines;

a plurality of flights mounted to the shaft and extending outwardly therefrom for intercepting pieces of material falling from the tines on the drum and turning and conveying material relative to the shaft.

8. The drum apparatus as set forth in claim 7, wherein:

the flights mounted on the shaft include a plurality of tines, said flights extending substantially longitudinally along the shaft, and said tines extending outwardly from said shaft.

9. The drum apparatus as set forth in claim 8, wherein:

the tines in the flights mounted to the drum have distal ends which are bent to define a helical path along the length of the drum.

10. In a drum for a rotatably driven dehydrator through which pieces of material are passed and dried by hot gases, the drum being hollow, open at either end and including a longitudinally extending shaft, the improvement comprising:

a plurality of flights are mounted along the inner surface of the hollow drum, each flight extending from one end of the drum to the other end, the flights being spaced circumferentially about the inner surface of the drum, each flight comprising a plurality of tines extending inwardly from the inner surface of the drum at least some of the tines in each flight being bent such that the distal ends of the tines substantially describe a helix in the longitudinal direction;

a plurality of flights are mounted to the shaft, each flight extending longitudinally therealong and comprising a plurality of tines extending outwardly from the shaft, the flights being spaced circumferentially about the shaft;

the ends of the tines on the shaft and drum being spaced so as to provide a cylindrical open space between the radius of revolution of the tines on the drum and the tines on the shaft.

* * * * *